US007282101B2

(12) United States Patent
McCurdy

(10) Patent No.: US 7,282,101 B2
(45) Date of Patent: Oct. 16, 2007

(54) METHOD FOR DISSOLVING A SOLID MATERIAL IN A LIQUID

(76) Inventor: Brent K. McCurdy, P.O. Box 32, Bryn Athyn, PA (US) 19009

( * ) Notice: Subject to any disclaimer, the term of this patent is extended or adjusted under 35 U.S.C. 154(b) by 298 days.

(21) Appl. No.: 10/642,668

(22) Filed: Aug. 19, 2003

(65) Prior Publication Data

US 2005/0039780 A1 Feb. 24, 2005

(51) Int. Cl.
*B08B 7/00* (2006.01)

(52) U.S. Cl. ..... 134/42; 134/56 R; 134/58 R; 134/123; 137/3; 210/745; 366/142

(58) Field of Classification Search ..... 210/696, 210/697, 745, 709, 726, 738, 739; 252/527, 252/528; 366/151.1, 152.1, 142, 348, 601; 422/269, 281; 137/3, 88, 268; 134/18, 29, 134/26, 34, 42, 56 R, 58 R, 123; 436/164, 436/172; 15/DIG. 2
See application file for complete search history.

(56) References Cited

U.S. PATENT DOCUMENTS 3,605,775 A * 9/1971 Zaander et al. ..... 210/709
3,816,351 A * 6/1974 Lancz ..... 510/241
4,855,061 A * 8/1989 Martin ..... 210/709
5,048,139 A * 9/1991 Matsumi et al. ..... 8/158
5,102,625 A 4/1992 Milo
5,308,499 A * 5/1994 Dixon et al. ..... 210/705
5,413,719 A * 5/1995 Sivakumar et al. ..... 210/745
5,439,020 A 8/1995 Lockhart
5,498,546 A * 3/1996 Kuhlmann et al. ..... 436/55
5,678,593 A 10/1997 Lockhart
5,899,605 A 5/1999 Caruthers, Jr. et al.
6,157,442 A 12/2000 Raskas
6,315,909 B1 * 11/2001 Hoots et al. ..... 210/745
6,394,111 B1 5/2002 Jacobs et al.
6,821,428 B1 * 11/2004 Zeiher et al. ..... 210/634
2001/0033805 A1 10/2001 Jacobs et al.

* cited by examiner

*Primary Examiner*—Joseph Drodge
(74) *Attorney, Agent, or Firm*—Stephen R. Greiner

(57) ABSTRACT

A method for dissolving a measured quantity of a solute in a solvent. First, a tracer is combined with a solute in known proportions to form a mixture. The tracer is capable of increasing the turbidity of a solvent in proportion to the concentration of the solute dissolved in the solvent. Then, a container is provided for receiving the mixture and the solvent. Next, the solvent and the mixture are introduced into the container. Finally, the solvent is stirred until its turbidity reaches a predetermined level.

11 Claims, 2 Drawing Sheets

METHOD FOR DISSOLVING A SOLID MATERIAL IN A LIQUID

FIELD OF THE INVENTION

The present invention relates generally to fluid handling processes wherein fluid flow or movement is controlled by a condition or characteristic of the fluid.

BACKGROUND OF THE INVENTION

Detergents used in automated car washes usually include two constituents: inorganic alkaline builders and organic surfactants. These detergents are typically delivered to car wash operators in concentrated liquid and powdered forms. Various problems, however, limit the concentration at which detergents can be distributed and reduce profits.

Because of their instability, liquid detergents must be diluted with water and enhanced with stabilizers to prevent their breakdown during transit and storage. The disadvantages associated with increasing the amount of water in a detergent are many, with manufacturing, packaging, transporting, and handling costs rising in proportion to the amount of water added. Of course, highly concentrated liquid surfactants, absent the usual inorganic compounds, can be bought, but they are considered to be less effective cleaners.

Detergents, delivered in powdered form, typically include a mix of finely divided phosphates, silicates and carbonates as well as a small amount of evenly distributed liquid surfactant. Generally, the surfactant concentration in the resulting detergent composition is limited to approximately 15 percent by weight. Excess amounts of the surfactant result in lumpy powders that will not flow through state of the art blending and dispensing equipment.

Dispensing a powdered detergent in a modern car wash is difficult. Hand measurement of the detergent by inexperienced workmen is time consuming and prone to mistake. Spraying an overly concentrated detergent onto a car is, of course, wasteful and can be harmful to the finish of the car. Further, prolonged and unchecked dampness can lead to consolidation of the powdered material into a solid block.

In an effort to overcome some of these problems, Barton Lockhart of Corsicana, Tex., proposed an improved detergent mixing system in U.S. Pat. Nos. 5,439,020 and 5,678,593. Lockhart uses a tank for dissolving powdered, inorganic, detergent constituents in water until a saturated detergent base is formed. With a venturi, the saturated detergent base is drawn from the tank and mixed with a surfactant and other liquid detergent constituents to make a complete detergent liquid.

The use of Lockhart's system by car wash operators throughout the United States for nearly a decade has shown it to be practical and cost-effective, but problems have occasionally arisen for some operators. For example, undissolved inorganics sometimes flow from the mixing tank in the detergent base, blocking downstream flow. It has been found, however, that injecting a small amount of water into the flow line conveying the saturated detergent base from the mixing tank causes any undissolved material to dissolve and inhibits the growth of crystals comprising dissolved inorganic material. Unfortunately, this injection of water makes it difficult to determine the exact concentration of saturated detergent base in the final detergent mix. Furthermore, water injection adds to the complexity of the system and can be a source of mistakes and confusion by operators of the system.

SUMMARY OF THE INVENTION

In light of the problems associated with the known systems for mixing liquid detergents, it is a principal object of the invention to provide a method that is capable of dissolving as much of, or as little of, a quantity of a powdered detergent constituent placed in a liquid as is desired. The method can be performed automatically and with a minimum of monitoring by one using the method.

It is another object of the invention to provide a method of the type described that can continuously produce a liquid containing a fixed concentration of a solute based on the turbidity of the liquid and despite the fact that the solute has little, if any, effect on turbidity.

It is an object of the invention to provide improved steps and arrangements thereof in a method for the purposes described that are inexpensive to perform and are dependable in their outcome.

Briefly, the method in accordance with this invention achieves the intended objects by including a novel combination of steps. First, a tracer and a solute are combined in known proportions to form a mixture with the tracer being capable of increasing the turbidity of a solvent in proportion to the concentration of the solute dissolved in the solvent. Then, a container is provided for receiving the mixture and a solvent. Next, a turbidimeter is coupled with the container. Afterward, the solvent and the mixture are admitted into the container thereby exposing the turbidimeter to the solvent so as to measure the turbidity of the solvent. Finally, the solvent is stirred until its turbidity, as measured by the turbidimeter, reaches a predetermined level. The now-turbid solvent can be drawn of for use as needed.

The method can be refined to produce a liquid detergent. To accomplish this end, an inorganic alkaline builder is employed as the solute and water is used as the solvent. After stirring of the water has been stopped due to such reaching the predetermined turbidity level, the water and the dissolved inorganic alkaline builder that it carries is drawn from the container and combined with a surfactant. The detergent can be employed in car washes or like apparatus.

The foregoing and other objects, steps, features and advantages of the present invention will become readily apparent upon further review of the following detailed description of the preferred embodiment as illustrated in the accompanying drawings.

DETAILED DESCRIPTION OF THE PREFERRED EMBODIMENT

The method for dissolving a solid material in a liquid in accordance with the present invention is straightforward. First, a tracer is combined with a solute in known proportions to form a mixture. Then, a container is provided for receiving the mixture and a solvent. Next, the solvent and the mixture are introduced into the container. Finally, the solvent is stirred until the turbidity thereof reaches a predetermined level.

To show the effectiveness of the method, an experiment was first conducted to determine whether a conventional alkaline builder had any effect on the turbidity of its solvent. The alkaline builder employed was HPH™ Powder sold by Blendco Systems, LLC, of Cinnaminson, N.J., as a constituent of a liquid detergent base for use by carwash operators. HPH™ Powder contains no easily measured or usable quantities of tracers. The solvent employed was water at room temperature. The following are the results:

TABLE 1

| Weight Percentage (%) | Turbidity (NTU) | Alkalinity (by Titration) |
|---|---|---|
| 4 | 8.71 | 168 |
| 5 | 12.7 | 210 |
| 6 | 14 | 252 |
| 7 | 14.7 | 294 |
| 8 | 19.3 | 336 |
| 9 | 19 | 378 |
| 10 | 17.3 | 420 |
| 11 | 20.3 | 462 |
| 12 | 3399 | 504 |

Figure 1:
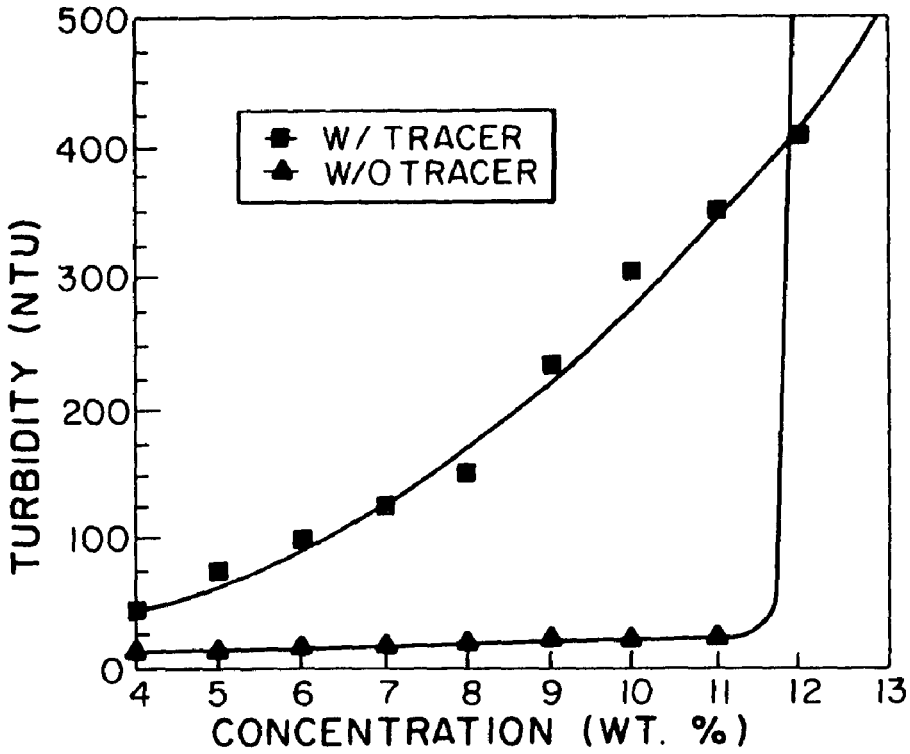
FIG. 1 is a graph depicting the turbidity of water having two different detergent constituents added in increasing concentrations.
Figure 2:
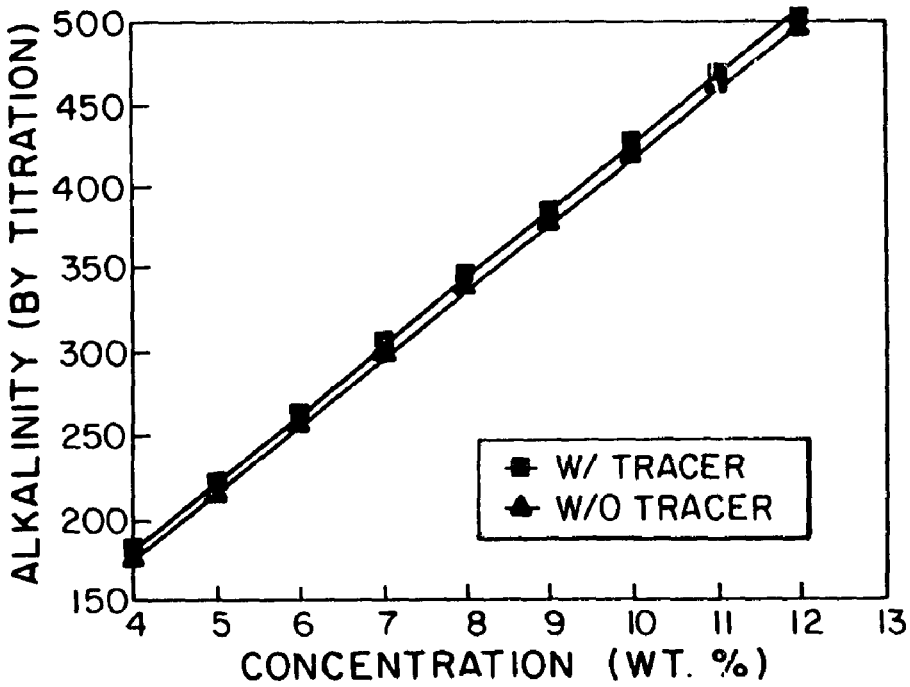
FIG. 2 is a graph depicting the alkalinity of water having the detergent constituents of FIG. 2 added in increasing concentrations.
Figure 3:
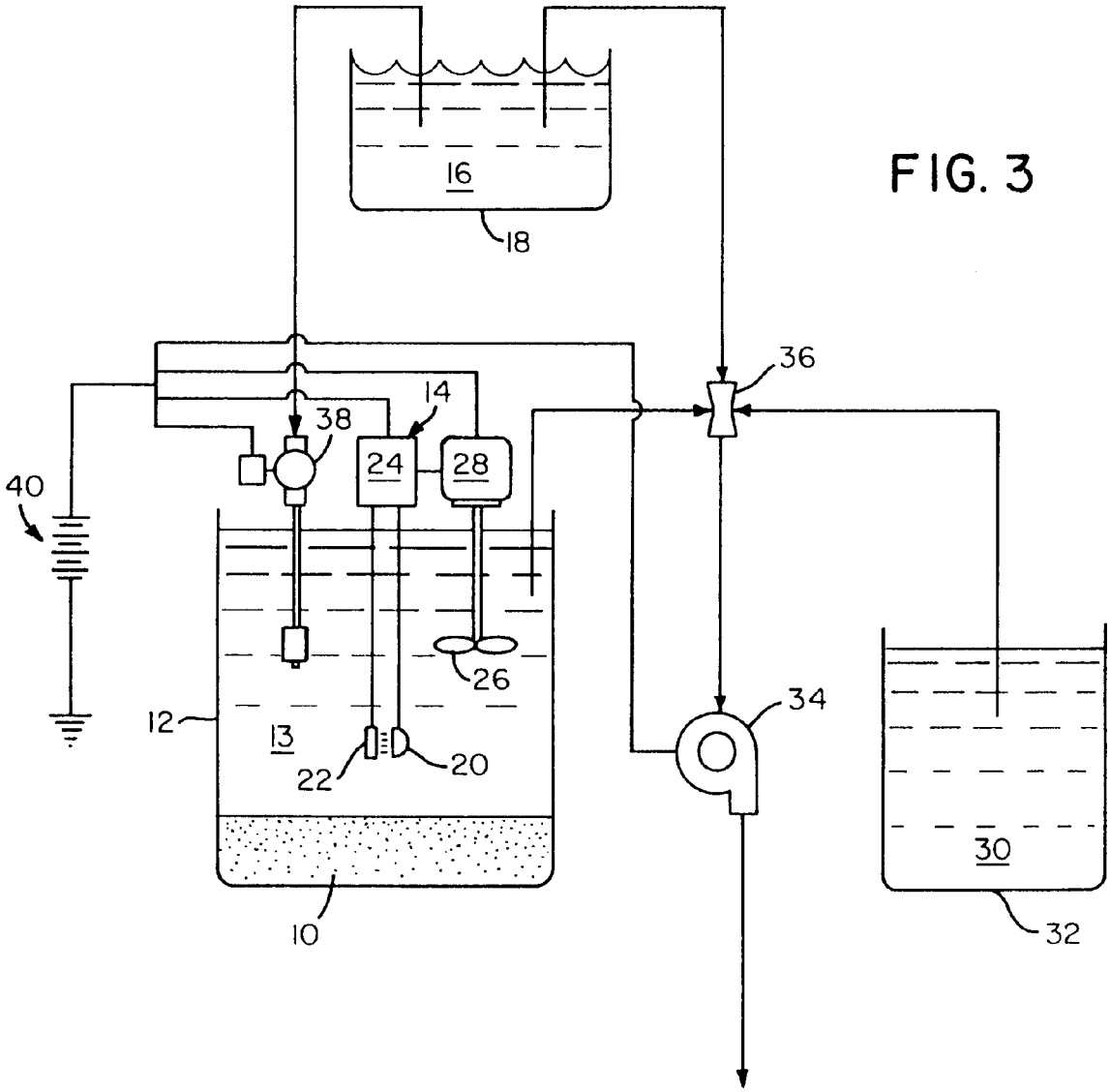
FIG. 3 is a schematic view of a detergent mixing apparatus employing the method of the present invention.

With reference to Table 1, the concentration of HPH™ Powder, measured as weight percentage in the first column from 4% to 11%, can be seen to have little effect on turbidity, measured in Nephelometric Turbidity Units in the second column, with turbidity increasing from 8.71 NTU to 20.3 NTU—a 133% increase over the measured range. At the concentration of 12%, water becomes saturated with HPH™ Powder and turbidity spikes upward as undissolved HPH™ Powder suspends therein as is most easily seen in FIG. 1 where the data of the second column is plotted graphically. Alkalinity increases linearly throughout the range, however, from 168 to 504 units as is best seen in FIG. 2 where the data of the third column is plotted graphically.

In the experiment, turbidity or cloudiness of the solvent, with the solute added, was measured in Nephelometric Turbidity Units (NTU). As is well known, clear water has a low NTU—usually in the range of 5 to 9 NTU. A liquid that is cloudy to the eye measures 20 or more NTU. Turbidity was measured by directing a beam of light from a source suspended within the solvent to a photodetector also suspended within the solvent, both being part of a turbidimeter. A controller connected to the photodetector converts the level of light received by the photodetector into a turbidity level.

In the experiment, titration was used to determine the alkalinity of the water/HPH™ Powder mixture described above. Here, a solution containing a known concentration of HCl (a titrant), was added progressively to a measured volume of the mixture (a titrand) that reacted with the titrant. The drop-by-drop addition was continued until an excess of neither the titrant or titrand remained as indicted by a color change from blue to yellow of an indicator dye (bromophenol blue) added to the titrand. A titrand having a low alkalinity, for example, required only a few drops of titrant to reach an end point where neither excess titrant or titrand remained in the mix whereas a titrand of high alkalinity required many drops of titrant to reach the end point.

Another experiment was conducted to determine whether a conventional alkaline builder combined with a tracer had any effect on the turbidity of its solvent. Here, HPH™ Powder was mixed with insoluble metaphosphate (IMP) such that the resulting mix included 99.9% HPH™ Powder by weight and 0.1% IMP by weight. Adding this mixture to water at room temperature and at varying concentrations produced the following results:

TABLE 2

| Weight Percentage (%) | Turbidity (NTU) | Alkalinity (by Titration) |
|---|---|---|
| 4 | 40.2 | 170 |
| 5 | 73.6 | 212 |
| 6 | 98 | 252 |
| 7 | 123 | 297 |
| 8 | 154 | 331 |
| 9 | 236 | 377 |
| 10 | 307 | 418 |
| 11 | 355 | 465 |
| 12 | 410 | 505 |
| 13 | 7058 | 546 |

With reference to Table 2, it can be seen in a small amount of IMP tracer has a marked influence on turbidity as the concentration of solute increases. In this instance, as the concentration of HPH™ Powder increases from 4% to 12%, the turbidity of the solvent with the tracer increases from 40.2 NTU to 410 NTU, an increase in turbidity of nearly 920% that is seven times the range found in the first experiment. This dramatic increase can be seen visually when plotted in FIG. 1 where the data from the second column of Table 2 is plotted in FIG. 1 adjacent that derived in the first experiment noted above. Alkalinity appears to increase linearly throughout the range and is substantially the same as that indicated in the first experiment as is shown when the data from the third column of Table 2 is plotted in FIG. 2. At the concentration of 13%, water is saturated with HPH™ Powder and turbidity spikes upwardly as undissolved HPH™ Powder becomes suspended therein. In short, the data indicates that the expanded turbidity range imparted by the tracer will permit a determination of concentration of the solute to be more easily and accurately accomplished with a turbidimeter throughout a range of concentrations than could be accomplished without use of the tracer.

Although IMP is used as a tracer in the second experiment, the tracer contemplated by this invention is any material capable of increasing the turbidity of a solvent in proportion to the concentration of the solute dissolved in the solvent. The preferred tracer is an inert material, but some may chemically react with the solute or solvent to a useful end. IMP, for instance, is inert in a detergent liquid and provides the liquid with a cloudy appearance when present at concentrations as low as 0.005 percent. Zeolite, on the other hand, is a tracer that acts as an alkaline builder to provide extra cleaning power to a detergent liquid. Other materials that could serve as a tracer in a detergent liquid may, by way of example only, include: sodium sulfate, calcium silicate, calcium phosphate, dibasic calcium phosphate, tribasic phosphate, magnesium carbonate, calcium carbonate, in addition to polymers and thickeners of various sorts.

Water would be the preferred solvent in most instances where a detergent liquid is involved, but other solvents may be used in the method contemplated by this invention. Examples of expected solvents would be: ethanols, methanols, isoproponols, and glycol ethers. Obviously, any suitable liquid may be employed as a solvent.

For methods involving detergent liquids, the preferred temperature range for the solvent (water) is 32° F. to 140° F. At the low end of the range, the solvent freezes or fails to dissolve effective amounts of solute. At the upper end of the range, however, the solvent becomes uncomfortable to work with and a scalding hazard. Interestingly, because turbidity increases with solute concentration and because solute concentration typically increases with temperature, the method is self-calibrating to the various temperatures.

The method of the present invention is particularly well adapted to producing detergent liquids for use in car washes. To this end, predetermined quantities of IMP (a tracer) and an inorganic alkaline builder (a solute) are combined in known proportions to form a powdery mixture 10 capable of dissolving in water. Then, a container 12, with a turbidimeter 14 coupled thereto, is provided for receiving the IMP/alkaline builder mixture 12 and water 16 (a solvent) from a pressurized source 18. Next, water 16 and the mixture 10 are introduced into container 12, dissolving a portion of mixture 10 in water 16 to form a liquid detergent base 13. The light source 20 and photodetector 22 of turbidimeter 14 are exposed to detergent base 13 in the container 12 so that a controller 24 connected to the photodetector 22 can convert the level of light received by the photodetector 22 into a measure of the turbidity of detergent base 13 in container 12.

As long as the level of light received by the photodetector 22 is greater than the predetermined threshold, detergent base 13 in the container 12 is stirred by a propeller 26 rotated by a motor 28 to dissolve the mixture 10. Once the turbidity of detergent base 13 in container 12, as measured by the turbidimeter 14, passes above the predetermined level, the motor 28 is deenergized. The now-turbid detergent base 13 is drawn from the container 12 and combined with a surfactant 30 from a remote source 32 and a jetted stream of water 16 from pressurized source 18 in a venturi 36 to form a complete detergent liquid. The complete detergent liquid is pressurized by a pump 34 for delivery to a carwash user.

As detergent base 13 is drawn from container 12 to venturi 36, the level of liquid within the container 12 drops. A solenoid-actuated float valve 38 detects a sufficient drop and permits the flow of water 16 from pressurized source 18 into container 12 so as to restore the liquid level to its original condition.

An electrical current source 40 powers the valve 38, controller 24, motor 28, and pump 34. Electrical current source 40 may, by way of example, be an electrical current grid or storage battery.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. A method for dissolving a measured quantity of a solute in a solvent comprising the steps of:

combining a tracer with a solute in known proportions to form a mixture, the tracer being capable of increasing the turbidity of a solvent in proportion to the concentration of the solute dissolved in the solvent;

providing a container for receiving the mixture and a solvent;

introducing the solvent and the mixture into the container;

stirring the solvent until the turbidity thereof reaches a predetermined level to produce a liquid detergent; and, employing the detergent in a car wash.

2. The method according to claim 1 wherein the tracer and the solute are finely divided solids both being capable of dissolving in the solvent.

3. The method according to claim 1 wherein the tracer is selected from the group consisting of: insoluble metaphosphate, zeolite, sodium sulfate, calcium silicate, calcium phosphate, dibasic calcium phosphate, tribasic phosphate, magnesium carbonate, calcium carbonate.

4. The method according to claim 1 wherein the solvent is selected from the group consisting of: water, ethanol, methanol, isoproponol, and glycol ether.

5. The method according to claim 1 wherein the amount of the mixture introduced to the container is sufficient to saturate the solvent.

6. The method according to claim 1 wherein the stirring step further includes:

directing a beam of light through the solvent to a photodetector; and, converting the light received by the photodetector into a turbidity level.

7. A method for dissolving a measured quantity of a solute in a solvent comprising the steps of:

combining a tracer with a solute in known proportions to form a mixture, the tracer being capable of increasing the turbidity of a solvent in proportion to the concentration of the solute dissolved in the solvent;

providing a container for receiving the mixture and a solvent;

providing a turbidimeter coupled with the container;

introducing the solvent and the mixture into the container;

exposing the turbidimeter to said solvent so as to measure the turbidity of the solvent;

stirring the solvent until the turbidity thereof, as measured by the turbidimeter, reaches a predetermined level to produce a liquid detergent; and, employing the detergent in a car wash.

8. The method according to claim 7 wherein the exposing step further includes:

directing a beam of light through the solvent to a photodetector being part of the turbidimeter; and, converting the light received by the photodetector into a turbidity level.

9. A method for producing a liquid detergent comprising the steps of:

combining a tracer with an inorganic alkaline builder in known proportions to form a mixture, the tracer being capable of increasing the turbidity of water in proportion to the concentration of the inorganic alkaline builder dissolved in the water;

providing a container for receiving the mixture and water;

providing a turbidimeter coupled with the container;

introducing water and the mixture into the container;

exposing the turbidimeter to the water in the container so as to measure the turbidity of the water in the container;

stirring the water in the container until the turbidity thereof, as measured by the turbidimeter, reaches a predetermined level;

drawing turbid water from the container and combining the turbid water with a surfactant to produce a liquid detergent; and, employing the detergent in a car wash.

10. The method according to claim 9 wherein the exposing step further includes:

directing a beam of light through the solvent to a photodetector being part of the turbidimeter; and, convening the light received by the photodetector into a turbidity level.

11. The method according to claim 9 wherein the tracer is selected from the group consisting of: insoluble metaphosphate, zeolite, sodium sulfate, calcium silicate, calcium phosphate, dibasic calcium phosphate, tribasic phosphate, magnesium carbonate, calcium carbonate.

* * * * *